US008452201B2

(12) United States Patent
Lee

(10) Patent No.: US 8,452,201 B2
(45) Date of Patent: May 28, 2013

(54) DYNAMIC FIELD TRANSFER CONTROL IN FIRST TRANSFER

(75) Inventor: Joannne Lai Zen Lee, Rochester, NY (US)

(73) Assignee: Xerox Corporation, Norwalk, CT (US)

( * ) Notice: Subject to any disclaimer, the term of this patent is extended or adjusted under 35 U.S.C. 154(b) by 793 days.

(21) Appl. No.: 12/612,121

(22) Filed: Nov. 4, 2009

(65) Prior Publication Data

US 2011/0102818 A1 May 5, 2011

(51) Int. Cl.
*G03G 15/16* (2006.01)
*G03G 15/01* (2006.01)

(52) U.S. Cl.
USPC ..... 399/66; 399/302

(58) Field of Classification Search
USPC ..... 399/11, 15, 66, 72, 299, 302, 314
See application file for complete search history.

(56) References Cited

U.S. PATENT DOCUMENTS 5,041,878 A * 8/1991 Takai et al. ..... 399/302
6,347,200 B1 * 2/2002 Shigeta et al. ..... 399/66
6,611,665 B2 8/2003 DiRubio et al.
6,807,390 B2 10/2004 Suda et al.
6,917,770 B2 7/2005 Bae et al.
7,024,125 B2 4/2006 Ishi et al.
8,306,443 B2 * 11/2012 DiRubio et al. ..... 399/49
2006/0165424 A1 7/2006 Tabb et al.
2006/0222381 A1 10/2006 Moriya et al.
2008/0152369 A1 6/2008 DiRubio et al.
2008/0152371 A1 6/2008 Burry et al.
2012/0269526 A1 * 10/2012 Lee et al. ..... 399/49

FOREIGN PATENT DOCUMENTS

DE 3115352 A1 4/1981
JP 356146156 A1 11/1981
JP 01206057 A * 8/1989

* cited by examiner

*Primary Examiner* — Robert Beatty
(74) *Attorney, Agent, or Firm* — Fay Sharpe LLP

(57) ABSTRACT

Multi-color document processing systems and operating methods are disclosed to control retransfer by providing a user-selected secondary operating mode in which marking devices not needed for a particular print job are disabled and one or more required devices are operated at reduced transfer field levels for the first transfer of marking material onto an intermediate transfer structure.

19 Claims, 6 Drawing Sheets

DYNAMIC FIELD TRANSFER CONTROL IN FIRST TRANSFER

BACKGROUND

The present disclosure relates to multi-color document processing systems such as printers, copiers, multi-function devices, etc., and to control techniques for operating the same. The disclosures of Published U.S. Patent Application Nos. 2008/0152369 to DiRubio et al. and 2008/0152371 to Burry et al. and the disclosure of U.S. patent application Ser. No. 12/581,281, filed Oct. 19, 2009 and entitled "Multi-Color Printing System and Method for Reducing the Transfer Field Through Closed-Loop Controls" are hereby incorporated by reference in their entireties. Multi-color toner-based Xerographic printing systems typically employ two or more xerographic marking devices to individually transfer toner of a given color to an intermediate transfer structure, such as a drum or belt (referred to as first transfer operations), with the toner being subsequently transferred (in a second transfer operation) from the intermediate medium to a sheet or other final print medium, after which the twice transferred toner is fused to the final print. Retransfer occurs when toner on the intermediate belt from previous, upstream marking devices is wholly or partially removed (scavenged) due to high transfer fields within the current transfer nip. High fields in the transfer nips in the previous downstream marking devices can adversely modify the charge state of the toner on the intermediate transfer belt (ITB) through air breakdown mechanisms, further exacerbating retransfer. When this happens, the desired amount of one or more toner colors is not transferred to the final printed sheet, and the retransfer problem worsens as the number of colors increases. Retransfer at a given marking device may be reduced by lowering the transfer field strength at that device, but this may lead to incomplete transfer during image building at that device. In other words, the transfer nip may be transferring toner to the ITB at one region in the cross-process direction (image building), which requires high fields, while simultaneously scavenging toner from the ITB in another region (retransfer). In addition, the quality requirements of multi-color document processing systems are constantly increasing, with customers demanding improved imaging capabilities without adverse effects of retransfer and incomplete transfer. Accordingly, a need remains for improved multi-color document processing systems and operational techniques through which retransfer and the aforementioned problems can be mitigated.

BRIEF DESCRIPTION

The present disclosure provides multi-color document processing systems and operating techniques that may be employed to control retransfer and incomplete transfer in systems having multiple marking devices by providing a secondary operating mode in which marking devices not needed for a particular print job are disabled and one or more required devices are operated at reduced transfer field levels for the first transfer of marking material (e.g., toner) to the intermediate transfer structure.

Methods are disclosed for operating a multi-color document processing system having two or more marking stations or marking devices that transfer toner or other marking material in a first transfer operation onto a belt, drum, or other intermediate transfer structure. The method involves allowing a user to select either a first mode for normal processing of a print job, or a second mode for intelligent first transfer field reduction before printing. If the user chooses the first mode, the job is processed with first transfer components of the marking devices operating at predetermined first transfer field levels. If the user instead selects the second mode, a determination is made as to which marking devices are needed to process the colors required for the print job, and the transfer field levels of these selected devices are reduced to predetermined second transfer field levels, while the non-selected marking devices are disabled. The print job is then processed with the first transfer components of the selected marking device(s) operating at the second transfer field levels to thus mitigate retransfer.

In certain embodiments, the method allows the user to selectively approve or disapprove the use of the second transfer field levels before processing the print job, such as by printing or displaying one or a few pages of the print job for user approval or disapproval, with the second levels being automatically increased if the test is not approved, or with the user optionally being able to adjust one or more of the second transfer field levels before processing the print job. In some implementations, the user is allowed to adjust the second transfer field levels before rendering the test page and/or before processing the print job.

A document processing system is disclosed, with a belt, drum, or other intermediate transfer structure, as well as a plurality of marking devices which include a first transfer field component controlling the first transfer field used to transfer marking material onto the intermediate structure. A secondary transfer component is located downstream of the marking devices along the intermediate transfer path to transfer marking material from the intermediate transfer structure to a printable medium. A controller operates the marking devices according to a print job to transfer marking material onto the intermediate transfer structure and provides transfer field level signals or values to control the transfer fields at the individual marking devices, and the controller is operative in one of two user-selectable modes. In a first or normal mode, the controller provides the transfer field level signals or values at predetermined first transfer field levels to process the print job. In a second or customer mode, the controller determines selected marking devices required for processing the print job, disables any non-selected marking devices, sets the transfer field levels for the selected devices to predetermined second transfer field levels lower than the first transfer field levels used in normal mode, and processes the job with the first transfer components operating at the second transfer field levels.

In some embodiments, the controller allows the user to select either the first mode or the second mode for processing a given print job, and may allow the user to selectively approve or disapprove the use of the second transfer field levels before processing the print job in the second mode. In certain implementations, moreover, the controller causes selected marking devices to render one or more print job pages with the first transfer components operating at the second transfer field levels and presents rendered page(s) or image(s) to the user for approval or disapproval of the transfer field levels, such as by printing one or more test sheets and/or by displaying a test image or images on a user interface for inspection by the user prior to processing the full print job. If the user approves the rendered page(s), the controller processes the job at the second transfer field levels, and if not, adjusts one or more of the second transfer field levels (automatically increasing or allowing the user to set one or more of the levels) before the print job is processed. The controller may optionally let the user adjust the second levels prior to rendering the test page(s)/image(s).

BRIEF DESCRIPTION OF THE DRAWINGS

The present subject matter may take form in various components and arrangements of components, and in various steps and arrangements of steps. The drawings are only for purposes of illustrating preferred embodiments and are not to be construed as limiting the subject matter, in which.

DETAILED DESCRIPTION

Figure 1:
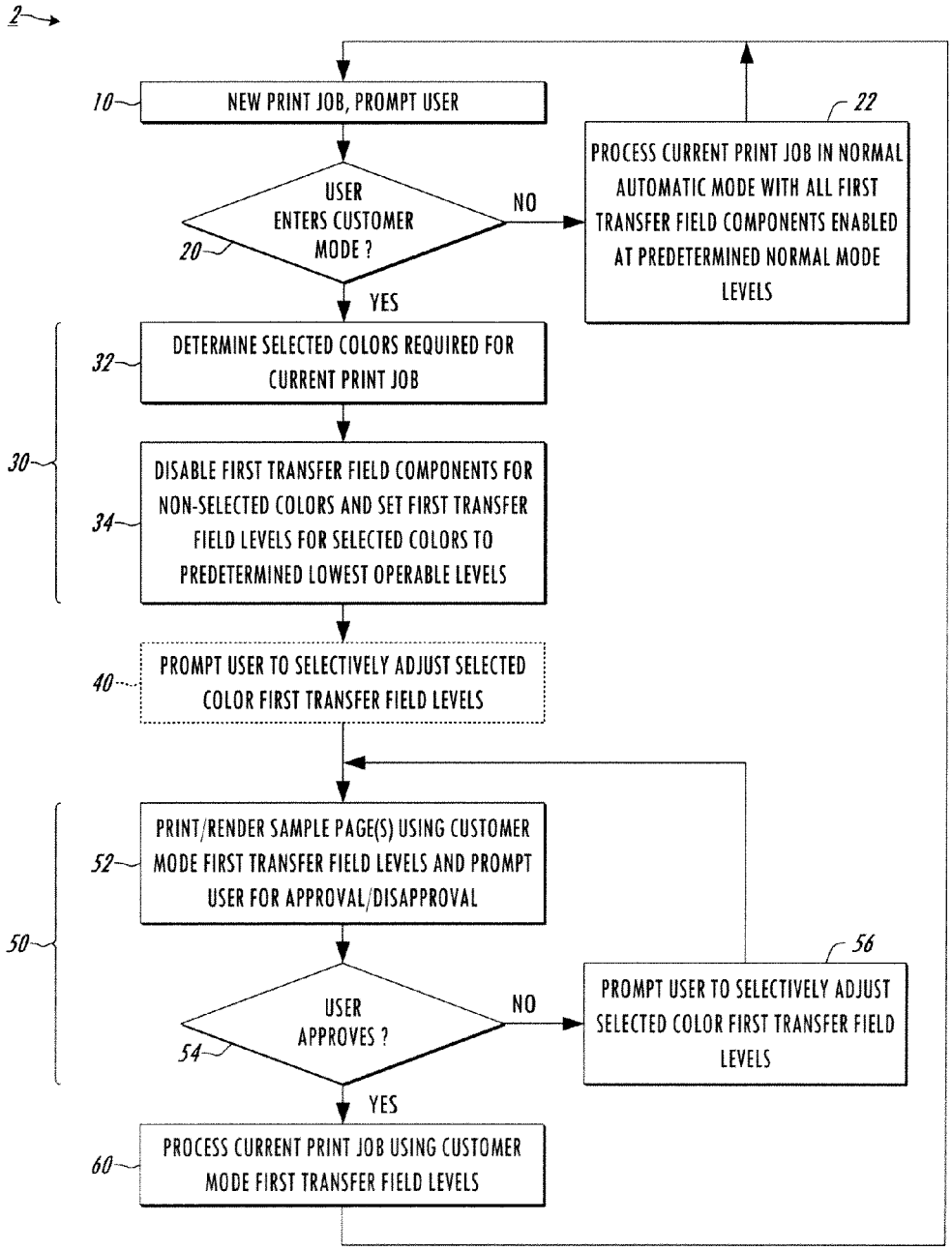
FIG. 1 is a flow diagram illustrating an exemplary method for operating a document processing system in accordance with one or more aspects of the disclosure.

Several embodiments or implementations of the different aspects of the present disclosure are hereinafter described in conjunction with the drawings, wherein like reference numerals are used to refer to like elements throughout, and wherein the various features, structures, and graphical renderings are not necessarily drawn to scale. Certain embodiments are illustrated and described below in the context of exemplary multi-color document processing systems that employ multiple xerographic marking devices or stations in which toner marking material is first transferred to an intermediate structure and ultimately transferred to a final print medium to create images thereon in accordance with a print job. However, the techniques and systems of the present disclosure may be implemented in other forms of document processing or printing systems that employ any form of marking materials and techniques in which marking device fields are used for material transfer, such as ink-based printers, etc., wherein any such implementations and variations thereof are contemplated as falling within the scope of the present disclosure.

An exemplary method 2 is illustrated in FIG. 1, and FIGS. 2-8 illustrate an exemplary tandem multi-color document processing system 100 having a plurality of marking devices which may be operated according to the exemplary method 2, wherein marking devices as used herein includes without limitation marking engines, marking stations, etc. The method 2 involves operating the marking devices in a normal mode to selectively transfer marking material onto an intermediate transfer medium in accordance with a print job with transfer field elements of the devices being operated at a first set of field levels, and in a second or customer mode where unneeded devices (those associated with colors not required for the print job) are disabled and the required devices are set to second transfer field levels to avoid or mitigate adverse retransfer conditions and other transfer field-related problems. While the exemplary method 2 is illustrated and described in the form of a series of acts or events, the various methods of the disclosure are not limited by the illustrated ordering of such acts or events except as specifically noted, and some acts or events may occur in different order and/or concurrently with other acts or events apart from those illustrated and described herein, and not all illustrated steps may be required to implement a process or method in accordance with the present disclosure. The illustrated method 2, moreover, may be implemented in hardware, processor-executed software, or combinations thereof, in one or more control elements operatively associated with a document processing system in order to provide the selective functionality set forth herein for a given print job, such as in a printing system as shown in FIGS. 2-7, wherein the disclosure is not limited to the specific applications and implementations illustrated and described herein.

Figure 2:
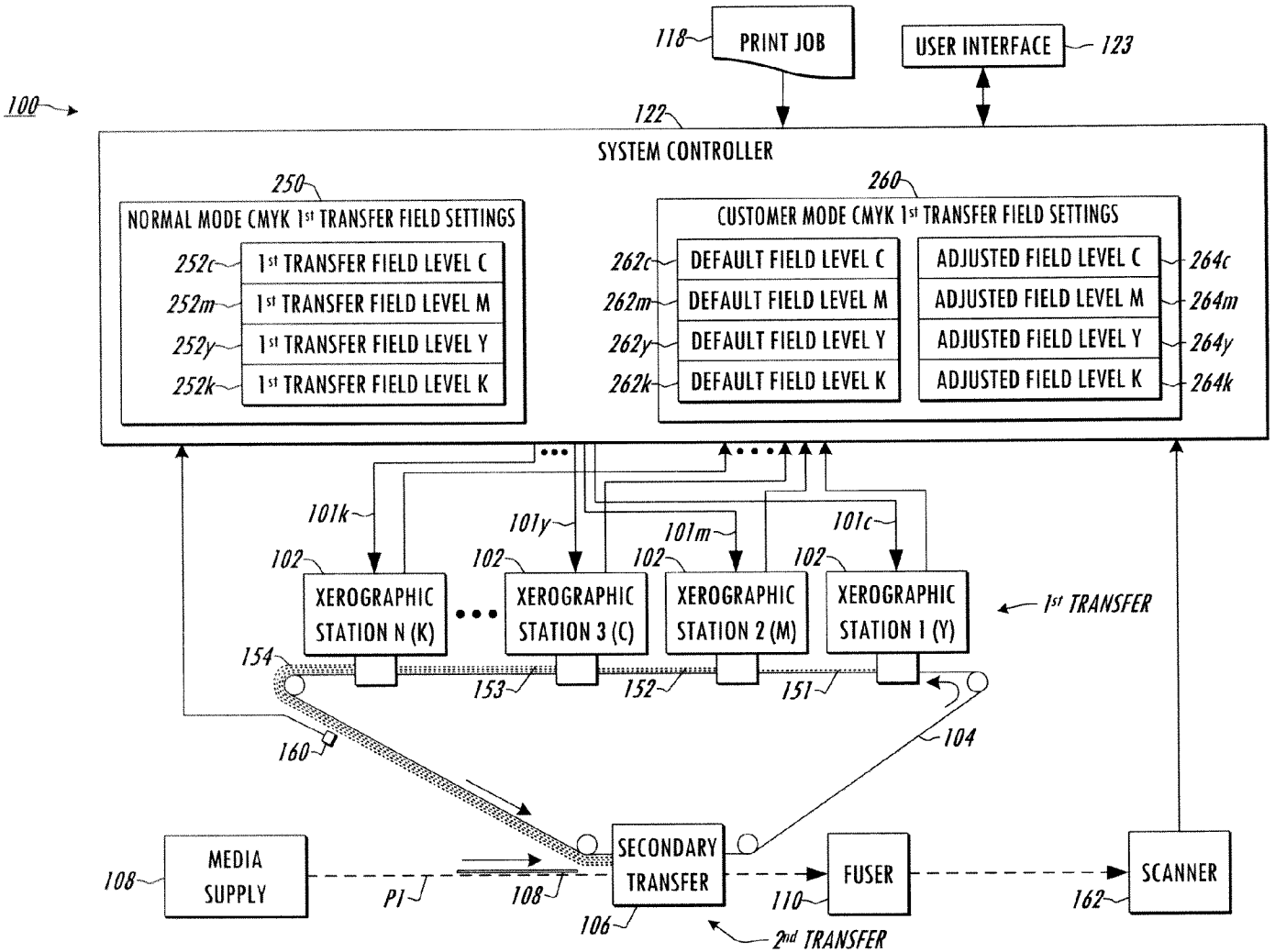
FIG. 2 is a simplified schematic system level diagram illustrating an exemplary multi-color document processing system with multiple xerographic marking devices disposed along a shared intermediate transfer structure (ITB) with a controller configured allow a user to enter a customer mode in accordance with certain aspects of the disclosure.
Figure 3:
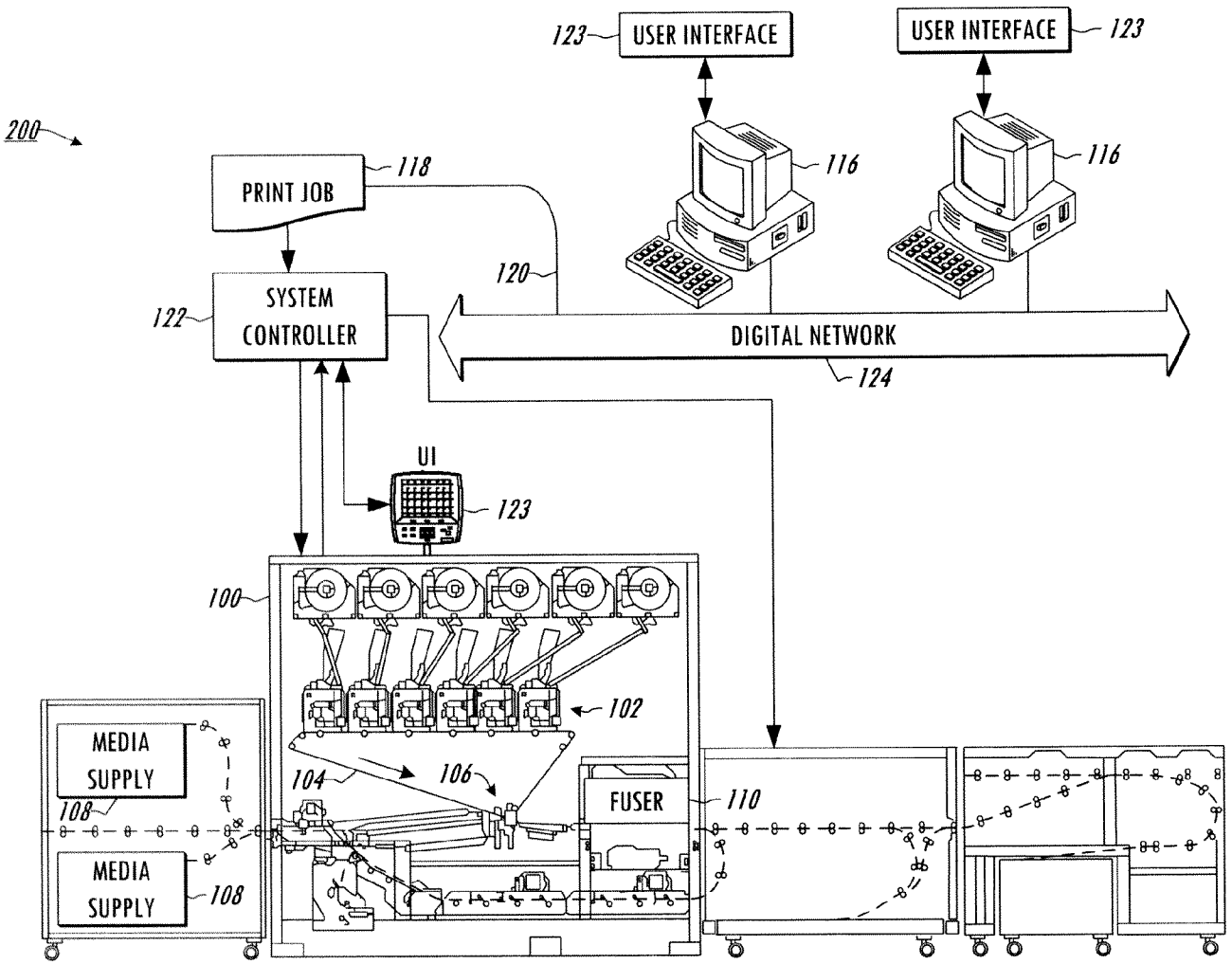
FIG. 3 is a detailed side elevation view illustrating an exemplary six color embodiment of the system of FIG. 2 in accordance with the present disclosure.
Figure 4:
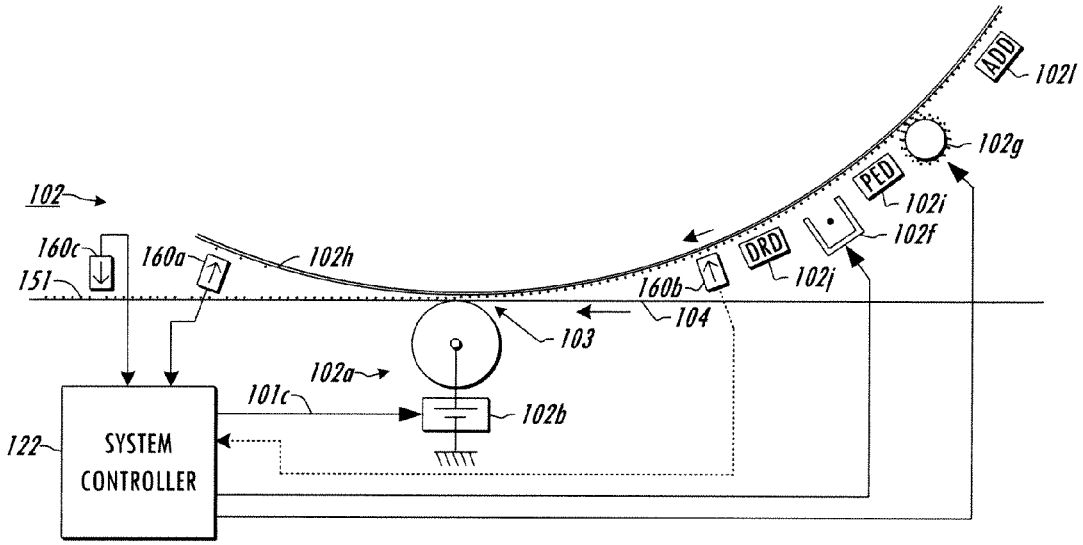
FIG. 4 is a schematic diagram illustrating further details of one of the marking devices in the system of FIGS. 1-3.

Referring to FIGS. 2-4, the document processing system 100 and a system controller 122 and marking devices 102 thereof may be operated in accordance with the method 2 in a normal printing mode and in a second 'customer' mode according to various aspects of the present disclosure. The system 100 includes a plurality of xerographic marking devices 102 individually operable by the controller 122 to transfer toner marking material onto an intermediate transfer structure 104, in this case, a shared intermediate transfer belt (ITB) 104 traveling in a counter clockwise direction in the figures past the xerographic marking devices 102, also referred to as marking engines, marking elements, marking stations, etc. In other embodiments, a cylindrical drum may be employed as an intermediate transfer structure with marking devices 102 positioned around the periphery of the drum to selectively transfer marking material thereto in a first transfer operation.

As best shown in FIG. 4, each exemplary xerographic marking device 102 includes a photoreceptor drum **102*h*, a pre-transfer charging subsystem 102*f*, a development subsystem 102*g*, a pre-transfer erase device (PED) 102*i*, and a pre-transfer debris removal device (DRD) 102*j*, by which the toner image of a given color (e.g., cyan, magenta, yellow, black, or one or more spot toners or gamut extension colors such as orange or violet) is developed on the photoreceptor 102*h* and transferred electrostatically to the intermediate transfer structure 104 using a biased transfer roller (BTR) 102*a* located on the inside of the intermediate transfer belt 104. The BTR 102*a* operates at a transfer field value provided by a field strength control device 102*b* according to a first transfer field level signal or value 101*c* provided by the controller 122 for setting the transfer field used by the device 102 to transfer marking material, in this case, toner, to the structure 104. The PED 102*i* operates to at least partially discharge the photoreceptor 102*h*, an ADD device 102*l* operates to reduce toner adhesion, and the DRD device 102*j* removes carrier beads or other large contaminants from the photoreceptor 102*h* prior to the first marking material being transferred onto the belt 104**.

In operation of the device 102, marking material (e.g., toner 151 for the first (Yellow) device 102 detailed in FIG. 4) is supplied to the drum **102*h*. In a first transfer operation, a surface of the intermediate medium 104 is adjacent to and/or in contact with the drum 102*h* and the toner 151 is transferred to the medium 104 with the assistance of the biased transfer roller 102*a*, where the BTR 102*a* induces charge into the BTR and the intermediate structure surface 104 to attract oppositely charged toner 151 from the drum 102*h* to the belt surface as it passes through a nip 103 created between the drum 102*h* and the charged transfer roller 102*a*, where the transfer charging is controlled by a bias control 102*b* operated by the system controller 122. The toner 151 ideally remains on the surface of the ITB 104** after it passes through the nip 103 for subsequent transfer (along with any other toner 152-154 transferred by downstream devices 102) and ultimately fusing to the final print media 108 via the secondary transfer device 106 and fuser 110 (FIGS. 2 and 3).

As also shown in FIG. 4, the individual marking devices 102 may include one or more sensors 160 for sensing toner adhesion, toner mass per unit area, or other marking material transfer characteristic associated with the drum 102*h* and/or the intermediate transfer structure 104. The device-specific sensors 160 in FIG. 4 provide input signals or values to the controller 122, such as an optical (e.g. reflective) sensor 160*a* downstream of the BTR 102*a* for sensing the residual mass per unit area (RMA) of marking material (e.g., toner) 151 not transferred from the drum 102*h* to the belt 104, and an optional sensor 160*b* upstream of the BTR 102*a* for sensing the developed toner mass per unit area (DMA) or an optional sensor (e.g. an optical reflectance sensor) 160*c* downstream of the BTR 102*a* for sensing the transferred mass per unit area on the ITB 104. One or more sensors 160 may be provided for measuring a marking material transfer condition of the medium 104 separate from any of the marking devices 102, such as the sensor 160 shown in FIG. 2. Any type of sensor or sensors 160 may be employed which measure or sense toner state characteristics from which the toner transfer state of the marking device 102 can be derived. Suitable types of sensors 160 are described in DiRubio et al., U.S. Pat. No. 7,190,913, filed Mar. 31, 2005, owned by the assignee of the present disclosure, the entirety of which is incorporated by reference.

In normal operation, the marking devices 102 (e.g., FIG. 4) may suffer from incomplete transfer in which case a small amount of toner 151 remains on the drum 102*h* downstream of the BTR 102*a*, particularly for low transfer field levels. The exemplary sensor 106*a* is operatively coupled with the controller 122 and located proximate the downstream side of the drum 102*h* to detect the amount of untransferred toner 151 remaining on the drum 102*h*, where the illustrated example provides the sensor 160*a* as a residual mass per unit area (RMA) sensor that measures or senses the mass of residual toner 151 per a given area on the drum surface remaining after the drum 102*h* passes the nip 103. The device 102 (or the system 100 generally) can optionally include additional sensors, such as a transferred mass/area (TMA) sensor 160*c* for sensing the amount of toner 151 that is transferred to the intermediate medium 104, and a developed mass/area (DMA) sensor 160*b* that detects the amount of toner 151 supplied on the drum 102*h* upstream of the nip 103.

As illustrated in FIGS. 2 and 3, any integer number N marking devices 102 may be included in the system 100 of FIG. 1, where N is two or more. In one exemplary implementation, the system 100 may include six such marking devices 102, as in the example of FIG. 3, and typical systems 100 may include four devices 102, one each for yellow (Y, toner 151), magenta (M, toner 152), cyan (C, toner 153) and black (K, toner 154). The marking devices 102 individually include at least one first transfer field component (e.g., 102*b* in FIG. 4) controlling a first transfer field used to transfer marking material (151-154) onto the intermediate transfer structure 104 with a transfer field control input receiving a first transfer field level signal or value 101 from the controller 122. As best shown in FIG. 2, each of the xerographic marking devices 102 is operable under control of the controller 122 to transfer toner 151-154 of a corresponding color to the intermediate transfer belt 104, where the first device 102 encountered by the ITB 104 in one example provides yellow toner 151, the next device provides magenta toner 152, the next provides cyan toner 153, and the last device 102 provides black toner 154, although other organizations and configurations are possible in which two or more marking devices 102 are provided.

The system 200 in FIG. 3 includes an embodiment of the document processing system 100 with six marking stations 102 along with a transfer station 106, a supply of final print media 108, and a fuser 110 as described in FIG. 2 above. In normal operation, print jobs 118 are received at the controller 122 via an internal source such as a scanner 162 and/or from an external source, such as one or more computers 116 connected to the system 100 via one or more networks 124 and associated cabling 120, or from wireless sources. Moreover, user prompting and selections can be made using a user interface 123 associated with the system 100 and/or with the computers 116.

As shown in FIGS. 2 and 3, the system 100 also includes a secondary transfer component 106 FIG. 2 disposed downstream of the marking devices 102 along a lower portion of the intermediate belt path to transfer marking material in a second transfer operation from the belt 104 to an upper side of a final print medium 108 (e.g., precut paper sheets in one embodiment) traveling along a path P1 from a media supply (FIG. 2). After the transfer of toner to the print medium 108 at the transfer station 106, the final print medium 108 is provided to a fuser type affixing apparatus 110 on the path P1 in which the transferred marking material is fused to the print medium 108. The system 100 may also include a scanner 162 or other suitable image sensing apparatus downstream of the secondary transfer component 106 for sensing the image created by the first and second transfer operations, and providing corresponding image signals or values to the controller 122.

The controller 122 is best illustrated in FIG. 2 and is operative to perform various control functions and may implement digital front end (DFE) functionality for the system 100, where the controller 122 may be any suitable form of hardware, processing component(s) with processor-executed software, processor-executed firmware, programmable logic, or combinations thereof, whether unitary or implemented in distributed fashion in a plurality of components, wherein all such implementations are contemplated as falling within the scope of the present disclosure and the appended claims. In a normal printing mode, the controller 122 receives incoming print jobs 118 and operates the marking devices 102 to transfer marking material onto the intermediate medium 104 in accordance with the print job 118, in particular, by providing first transfer field level signals or values 101 to control the transfer fields of the first transfer field components 102*b*. The controller 122, moreover, operates the secondary transfer component 106, the fuser 110, and the scanner 162 and interfaces with the various sensors 160 and the network 124 in the illustrated embodiments.

The controller 122 is user-operated to function in one of two modes, including a first (normal) mode and a second (customer) mode. In normal (first mode) operation, the controller 122 provides the transfer field level signals or values 101 at predetermined first transfer field levels 252 to process the print job 118. These values 252*c*, 252*m*, 252*y*, and 252*k* include specific field values for the individual colors C, M, Y, and K, which need not be the same. The first set of field levels 252, moreover, may be set during system manufacturing and may be updated from time to time, in automated fashion and/or manually. Suitable techniques for establishing the predetermined first set of transfer field levels 252 are set forth in U.S. patent application Ser. No. 12/581,281, filed Oct. 19, 2009 and entitled "Multi-Color Printing System and Method for Reducing the Transfer Field Through Closed-Loop Controls", incorporated herein by reference, for example.

The controller 122 is also operative in a second (customer) mode to determine which marking devices 102 correspond to colors required for processing the print job 118 (herein 'selected' device(s) 102) and also to selectively disable the first transfer components of any non-selected marking devices 102 (those associated with colors not required for processing the print job 118). In this regard, the second mode operation includes situations in which all colors are required for a given print job, no devices 102 are disabled. The controller 122 sets the transfer field levels via signals or values 101 provided to one or more selected marking devices 102 to predetermined second transfer field levels 262 (FIG. 2) which are lower than the first transfer field levels (252) so as to combat retransfer effects and other high transfer field defects in printing operation of the system 100. In this regard, toner state sensing via the sensor(s) 160 may be employed as feedback to the controller 122 for selective automatic adjustment of one or more first transfer field levels 262 in the second mode as described in greater detail below.

Referring again to FIG. 1 and to FIGS. 5-8, the system controller 122 may be operated in one embodiment generally in accordance with the method 2. The method 2 involves operating a document processing system, such as the illustrated system 100, having a plurality of marking devices 102 of different colors (e.g., C, M, Y, and K in one example), where the individual marking devices 102 are separately operable via the system controller 122 to transfer marking material 151-154 of corresponding colors in a first transfer operation onto the intermediate transfer structure 104. At 10 in FIG. 2, a new print job 118 is scheduled for printing or other image processing, and a user is allowed (e.g., via prompting by a user interface 123 at the system 100 or at a computer 116 in FIG. 3 or other device operatively coupled with the document processing system 100) to select either a first (normal) mode or a second (customer) mode for processing the print job 118.

Figure 5:
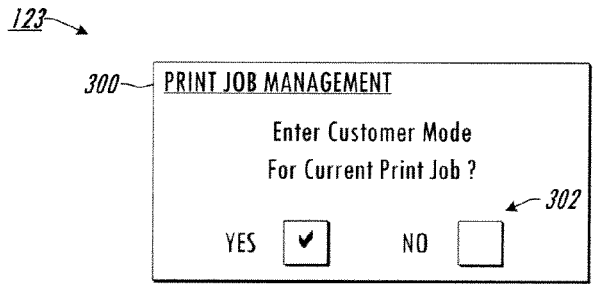
FIGS. 5-8 are partial side elevation views illustrating exemplary user prompts and interface screens in the systems of FIGS. 1-4.
Figure 6:
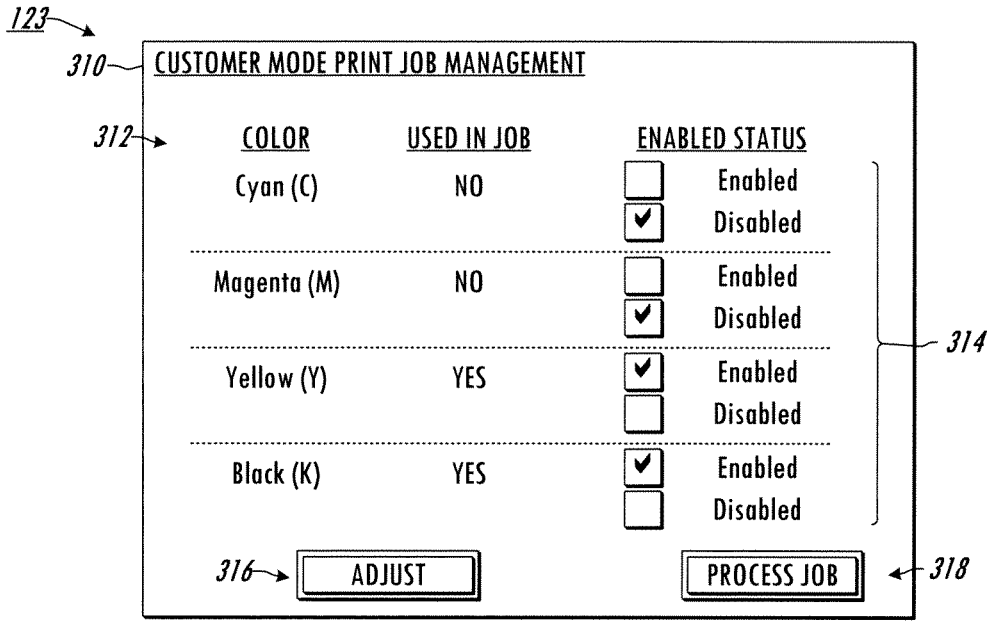

FIG. 5 illustrates an exemplary print job management display or screen 300 rendered in the on-board or computer-based user interface 123 associated with the system 100. For instance, the user may be prompted for selective use of the customer mode upon submitting the print job 118 at the computer 116 which presents the display screen 300, where the screen 300 includes user-actuatable selection indicia or controls 302 to choose either the normal (first) mode or the customer (second) mode, such as using a mouse or other pointing device, a keyboard, etc. Alternatively or in combination, the display prompt screen 300 may be presented to a user at the interface 123 integrated into the document processing system 100, which can include buttons, touch-screen, or other user-actuatable controls for making the selection between the first and second modes. In yet another implementation, the selection of the first or second mode can be incorporated as a parameter in the print job 118 itself. Moreover, if prompting is used for the selection at 10, 20, the normal mode is set as the default selection in certain embodiments.

Returning to FIG. 1, if the user selects the first mode (NO at 20), the print job 118 is processed at 22 by the controller 122 with first transfer components 102*b* of the marking devices 102 operating at the predetermined first transfer field levels 252 (FIG. 2). If the user instead selects the second mode (YES at 20), the system 100 is set for specialized processing at 30 for mitigating retransfer using settings appropriate for the particular current print job 118. The controller makes a determination at 32 of which one or more selected marking devices 102 are associated with colors required for processing the print job 118. At 34, the controller 122 disables the first transfer components 102*b* of any (zero or more) non-selected marking devices 102 associated with colors not required for processing the print job 118 and sets the transfer field level(s) for first transfer components 102*b* of one or more selected marking devices 102 to predetermined second transfer field levels 262 (e.g., default field levels 262*c*, 262*m*, 262*y*, and 262*k* in FIG. 2) which are lower than the first transfer field levels 252.

In certain implementations, the predetermined second transfer field levels 262 can be set to the lowest operable levels for the corresponding devices 102, where these default values can be determined during system manufacturing and may be updated thereafter, for example, using techniques as described in U.S. patent application Ser. No. 12/581,281, filed Oct. 19, 2009 and entitled "Multi-Color Printing System and Method for Reducing the Transfer Field Through Closed-Loop Controls", incorporated herein by reference. In certain embodiments, the controller 122 then processes the current print job 118 at 60 with first transfer components 102*b* of the selected marking devices 102 operating at the second transfer field levels 262, and the process 2 returns to 10 for the next print job 118.

Figure 7:
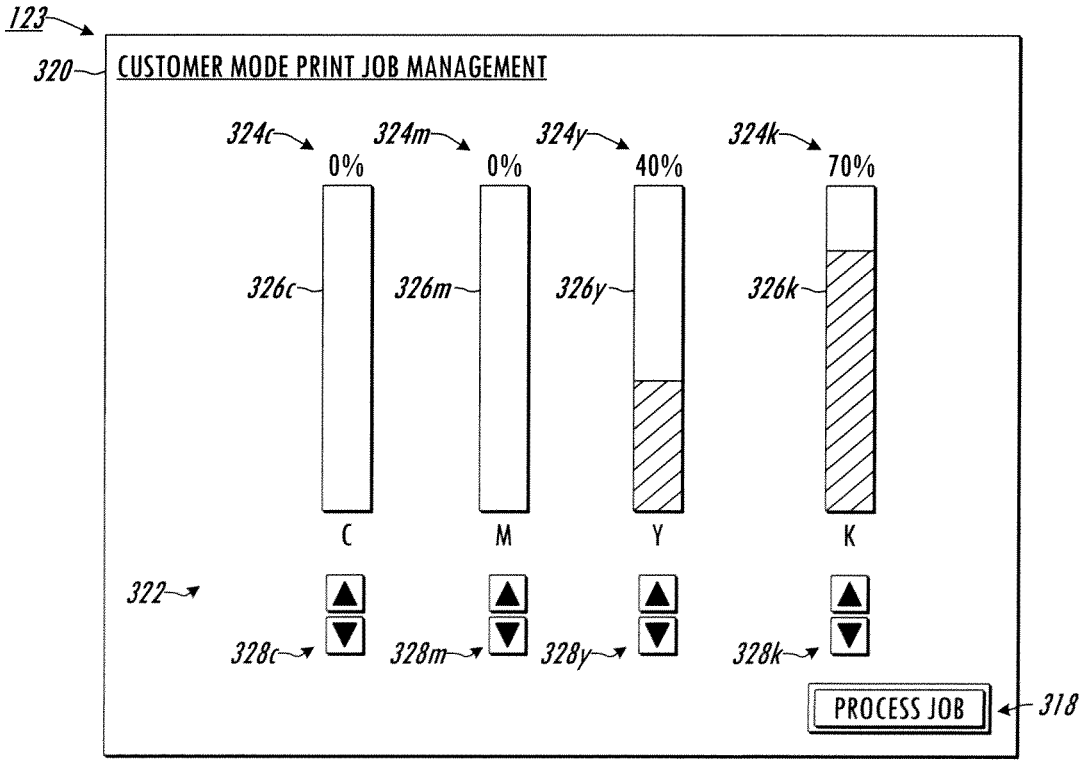

Referring to FIGS. 1 and 7, the controller in certain embodiments allows the user to selectively adjust one or more of the second transfer field levels 262 at 40 before the print job 118 is processed at 60. FIG. 7 illustrates an exemplary user prompt screen 320 with an adjustment view 322 which can be rendered to the user at 40 (at an interface 123 of the system 100 or on an associated computer 116) for adjusting one or more of the second levels 262 at 40. The controller 122 may indicate the current levels 262 to the user via numeric (e.g., percentage) values 324*c*, 324*m*, 324*y*, 324*k* and/or may graphically present percentage bar indicia 326*c*, 326*m*, 326*y*, and 326*k* to indicate the current field levels to the user. The screen 320 additionally provides user-actuatable up/down controls 328*c*, 328*m*, 328*y*, and 328*k* allowing the individual levels 262 to be adjusted. In other embodiments, the user may be able to directly adjust the numeric indicators 324 (e.g., via mouse and keyboard) and/or the bar indicia 326 (e.g., via mouse, keyboard, and/or touch screen) to adjust one or more of the field levels 262. The controller may preserve the predetermined second levels 262 and separately store adjusted field levels 264*c*, 264*m*, 264*y*, and/or 264*k* for use in processing the print job 118 at 60.

Referring to FIGS. 1 and 6-8, the controller 122 in certain embodiments also allows the user at 40 in FIG. 1 to selectively approve or disapprove the use of the second transfer field levels 262 before processing the print job 118 at 60, and may allow the user to review a test print or test display before approving the job 118 for full processing. In these embodiments, the user may be presented with a display screen 310 in FIG. 6 at 40 in FIG. 1, which indicates which of the marking devices 102 have been automatically disabled according to prospective use in the current print job 118, and which may further provide user-actuatable control indicia 314 allowing the user to selectively enable or disable individual marking devices 102 associated with the indicated colors. The exemplary screen 310 further provides user-actuatable control 316 allowing the user to choose to adjust one or more of the field levels 262 and control 318 for choosing to accept the settings and process the job 118.

As shown in FIG. 1, moreover, the method 2 may also provide test prints or images at 50 for user review prior to accepting the transfer field levels with optional level adjustments. In these embodiments, one or more pages of the print job 118 are rendered at 52 using the first transfer components 102*b* of the selected marking device(s) 102 operating at the second transfer field levels 262 (or adjusted levels 264), and presenting the rendered test page(s) to the user for approval or disapproval before full print job processing at 60. In one possible embodiment, one or more test pages are printed onto a final print medium 108 by first transferring marking material 151-154 from the selected marking devices 102 in one or more first transfer operations onto the intermediate structure 104 at the second transfer field levels 262, 264, and then transferring the marking material 151-154 from the intermediate structure 104 to the printable medium 108 via a second transfer operation for user approval or disapproval of the resulting printed sheet(s) 108.

Figure 8:
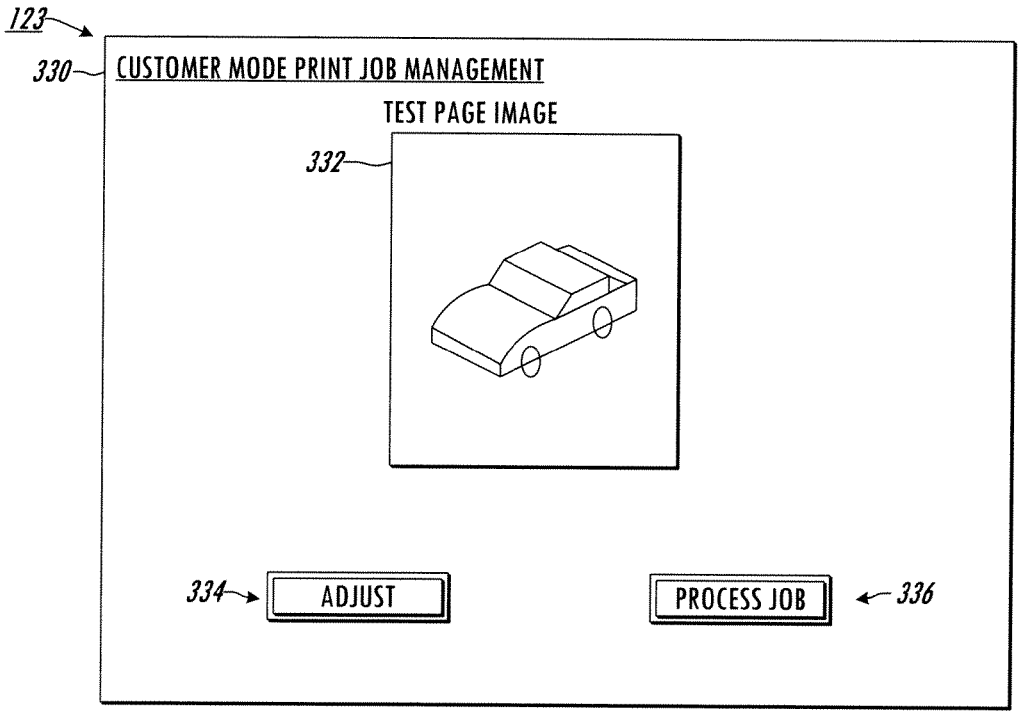

Referring also to FIG. 8, in other implementations, the printed sheet(s) can be scanned via scanner 162 (FIG. 2) and the scanned image 332 is presented to the user in a display screen 330 via the interface 123. In yet another embodiment, one or more test images are presented to the user via the interface 123, such as by the controller 122 causing the selected device(s) 102 to transfer marking material 151-154 onto the intermediate transfer structure 104 at the second transfer field levels 262, 264, and the toner image built on the intermediate structure 104 is sensed via one or more sensors 160 (FIG. 2) and a test image 332 is constructed by the controller 122 from the sensor information. The image 332 is then rendered at the interface 123 for user approval or disapproval at 52 in FIG. 1, and the user chooses whether or not to approve the test print/image at 54. If not (NO at 54), the screen 330 in FIG. 8 further includes user-actuatable control 334 for adjusting the first transfer field values (e.g., via screen 320 in FIG. 7) and a control 336 allowing the user to accept the levels 262, 264 (YES at 54 in FIG. 1) and proceed with processing of the full print job 118 at 60. In another embodiment, the level adjustment in the second mode may be automated, wherein if the user disapproves 54 the rendered page(s)/image(s) at 54, the controller 122 automatically increases one or more of the second transfer field levels 262 before processing the print job 118 at 60 (with optional re-rendering for further user approval decision at 52, 54). In certain embodiments, the controller 122 is provisioned with a highest operable field level or value for each device 102 and the automatic and manual adjustment is prevented from exceeding this limit. In this regard, the automatic adjustment embodiments mat in certain implementations include increasing the transfer field level until the highest operable field value is reached, after which the controller alerts the user that the transfer field has reach its maximum allowable level and prompts the user to either accept that level or return to the previous level. In one example, moreover, the highest operable field value can be the predetermined first transfer field if run in the first mode.

The above examples are merely illustrative of several possible embodiments of the present disclosure, wherein equivalent alterations and/or modifications will occur to others skilled in the art upon reading and understanding this specification and the annexed drawings. In particular regard to the various functions performed by the above described components (assemblies, devices, systems, circuits, and the like), the terms (including a reference to a "means") used to describe such components are intended to correspond, unless otherwise indicated, to any component, such as hardware, software, or combinations thereof, which performs the specified function of the described component (i.e., that is functionally equivalent), even though not structurally equivalent to the disclosed structure which performs the function in the illustrated implementations of the disclosure. In addition, although a particular feature of the disclosure may have been disclosed with respect to only one of several embodiments, such feature may be combined with one or more other features of the other implementations as may be desired and advantageous for any given or particular application. Also, to the extent that the terms "including", "includes", "having", "has", "with", or variants thereof are used in the detailed description and/or in the claims, such terms are intended to be inclusive in a manner similar to the term "comprising". It will be appreciated that various of the above-disclosed and other features and functions, or alternatives thereof, may be desirably combined into many other different systems or applications, and further that various presently unforeseen or unanticipated alternatives, modifications, variations or improvements therein may be subsequently made by those skilled in the art which are also intended to be encompassed by the following claims.

The invention claimed is:

1. A method of operating a document processing system having a plurality of marking devices of different colors individually operable to transfer marking material in a first transfer operation onto an intermediate transfer structure, the method comprising:

allowing a user to select either a first mode or a second mode for processing a given print job;

if the user selects the first mode, processing the print job with first transfer components of the marking devices operating at predetermined first transfer field levels; and if the user selects the second mode:

determining one or more selected marking devices associated with colors required for processing the print job;

disabling first transfer components of any non-selected marking devices associated with colors not required for processing the print job, setting transfer field levels for first transfer components of the one or more selected marking devices to predetermined second transfer field levels lower than the first transfer field levels, and processing the print job with first transfer components of the one or more selected marking devices operating at the second transfer field levels.

2. The method of claim 1, further comprising allowing the user to selectively approve or disapprove the use of the second transfer field levels before processing the print job.

3. The method of claim 2, comprising:

if the user selects the second mode, rendering at least one page of the print job using the first transfer components of the one or more selected marking devices operating at the second transfer field levels;

presenting the at least one rendered page to the user for approval or disapproval of the use of the second transfer field levels before processing the print job;

if the user approves the at least one rendered page, processing the print job with first transfer components of the one or more selected marking devices operating at the second transfer field levels; and if the user disapproves the at least one rendered page, adjusting one or more of the second transfer field levels before processing the print job with first transfer components of the one or more selected marking devices operating at the second transfer field levels.

4. The method of claim 3, wherein rendering at least one page of the print job comprises printing one or more test pages by transferring marking material from the one or more selected marking devices via one or more first transfer operations onto the intermediate transfer structure at the second transfer field levels, and transferring the marking material from the intermediate transfer structure to a printable medium via a second transfer operation for user approval or disapproval of a resulting printed medium.

5. The method of claim 3, wherein rendering at least one page of the print job comprises transferring marking material from the one or more selected marking devices via one or more first transfer operations onto the intermediate transfer structure at the second transfer field levels, and presenting an image for user approval or disapproval based at least partially on the marking material transferred onto the intermediate transfer structure.

6. The method of claim 3, wherein adjusting one or more of the second transfer field levels if the user disapproves the at least one rendered page comprises automatically increasing one or more of the second transfer field levels at or below a corresponding predetermined highest operable field level or value before processing the print job with first transfer components of the one or more selected marking devices operating at the second transfer field levels.

7. The method of claim 3, further comprising allowing the user to selectively adjust one or more of the second transfer field levels before rendering the at least one page of the print job.

8. The method of claim 2, further comprising allowing the user to selectively adjust one or more of the second transfer field levels before processing the print job.

9. The method of claim 1, further comprising allowing the user to selectively adjust one or more of the second transfer field levels before processing the print job.

10. A document processing system, comprising:

an intermediate transfer structure traveling along a path;

a plurality of marking devices disposed along the path and operative to transfer marking material onto the intermediate transfer structure, the individual marking devices comprising at least one first transfer field component controlling a first transfer field used to transfer marking material by the marking device onto the intermediate transfer structure with a transfer field control input for receiving a first transfer field level signal or value for setting the first transfer field used by the first transfer field component;

a secondary transfer component disposed downstream of the marking devices along the path to transfer marking material from the intermediate transfer structure to a printable medium; and a controller operatively coupled with the marking devices to selectively cause one or more of the marking devices to transfer marking material onto the intermediate transfer structure in accordance with a print job and to provide first transfer field level signals or values to control the transfer fields of the first transfer field components;

the controller being operative in a first mode to provide the transfer field level signals or values at predetermined first transfer field levels to process a print job; and the controller being operative in a second mode to determine one or more selected marking devices associated with colors required for processing the print job, to disable first transfer components of any non-selected marking devices associated with colors not required for processing the print job, to set transfer field levels for first transfer components of the one or more selected marking devices to predetermined second transfer field levels lower than the first transfer field levels, and to process the print job with first transfer components of the one or more selected marking devices operating at the second transfer field levels.

11. The document processing system of claim 10, wherein the controller is operative to allow a user to select either the first mode or the second mode for processing a given print job.

12. The document processing system of claim 10, wherein the controller is operative in the second mode to allow the user to selectively approve or disapprove the use of the second transfer field levels before processing the print job.

13. The document processing system of claim 12:

wherein the controller is operative in the second mode to cause the one or more selected marking devices to render at least one page of the print job using the first transfer components of the one or more selected marking devices operating at the second transfer field levels and to present the at least one rendered page for approval or disapproval of the use of the second transfer field levels before processing the print job;

wherein the controller is further operative if the user approves the at least one rendered page to cause the one or more selected marking devices to process the print job with first transfer components of the one or more selected marking devices operating at the second transfer field levels; and wherein the controller is further operative if the user disapproves the at least one rendered page to adjust one or more of the second transfer field levels before causing the one or more selected marking devices to process the print job with first transfer components of the one or more selected marking devices operating at the second transfer field levels.

14. The document processing system of claim 13, wherein the controller is operative in the second mode to render at least one page of the print job by causing the one or more selected marking devices to print one or more test pages by transferring marking material via one or more first transfer operations onto the intermediate transfer structure at the second transfer field levels, and by causing the secondary transfer component to transfer the marking material from the intermediate transfer structure to a printable medium via a second transfer operation for user approval or disapproval of a resulting printed medium.

15. The document processing system of claim 13, wherein the controller is operative in the second mode to render at least one page of the print job by causing the one or more selected marking devices to transfer marking material via one or more first transfer operations onto the intermediate transfer structure at the second transfer field levels, by and by presenting an image for user approval or disapproval based at least partially on the marking material transferred onto the intermediate transfer structure.

16. The document processing system of claim 13, wherein the controller is operative in the second mode if the user disapproves the at least one rendered page to automatically increase one or more of the second transfer field levels at or below a corresponding predetermined highest operable field level or value before processing the print job with first transfer components of the one or more selected marking devices operating at the second transfer field levels.

17. The document processing system of claim 13, wherein the controller is operative in the second mode to allow the user to selectively adjust one or more of the second transfer field levels before causing the one or more selected marking devices to render at least one page of the print job.

18. The document processing system of claim 13, wherein the controller is operative in the second mode to allow the user to selectively adjust one or more of the second transfer field levels before processing the print job with first transfer components of the one or more selected marking devices operating at the second transfer field levels.

19. The document processing system of claim 12, wherein the controller is operative in the second mode to allow the user to selectively adjust one or more of the second transfer field levels before processing the print job with first transfer components of the one or more selected marking devices operating at the second transfer field levels.

* * * * *

UNITED STATES PATENT AND TRADEMARK OFFICE

CERTIFICATE OF CORRECTION

PATENT NO. : 8,452,201 B2
APPLICATION NO. : 12/612121
DATED : May 28, 2013
INVENTOR(S) : Joanne Laizen Lee It is certified that error appears in the above-identified patent and that said Letters Patent is hereby corrected as shown below:

On the title page item (75) Inventor should read: Joanne Laizen Lee, Rochester, NY (US)

Signed and Sealed this
Tenth Day of December, 2013

Margaret A. Focarino

Margaret A. Focarino
*Commissioner for Patents of the United States Patent and Trademark Office*